US006942022B2

(12) United States Patent
Blangetti et al.

(10) Patent No.: US 6,942,022 B2
(45) Date of Patent: Sep. 13, 2005

(54) CONDENSATION HEAT-TRANSFER DEVICE

(75) Inventors: Francisco Blangetti, Baden (CH); Harald Reiss, Heidelberg (DE)

(73) Assignee: ALSTOM Technology Ltd., Baden (CH)

( * ) Notice: Subject to any disclaimer, the term of this patent is extended or adjusted under 35 U.S.C. 154(b) by 160 days.

(21) Appl. No.: 10/416,485

(22) PCT Filed: Nov. 7, 2001

(86) PCT No.: PCT/IB01/02079

§ 371 (c)(1),
(2), (4) Date: Oct. 9, 2003

(87) PCT Pub. No.: WO02/40934

PCT Pub. Date: May 23, 2002

(65) Prior Publication Data

US 2004/0069466 A1 Apr. 15, 2004

(30) Foreign Application Priority Data

Nov. 14, 2000 (DE) ..... 100 56 242

(51) Int. Cl.[7] ..... F28F 19/02
(52) U.S. Cl. ..... 165/133; 165/134.1
(58) Field of Search ..... 165/133, 134.1, 165/905, DIG. 512, DIG. 513, DIG. 514

(56) References Cited

U.S. PATENT DOCUMENTS

| | | | | |
|---|---|---|---|---|
| 4,601,933 A | * | 7/1986 | Nakamura et al. | 165/133 |
| 5,645,900 A | * | 7/1997 | Ong et al. | 427/571 |
| 5,846,613 A | * | 12/1998 | Neuville | 427/575 |
| 6,192,979 B1 | * | 2/2001 | Koch et al. | 165/201 |
| 6,571,865 B1 | * | 6/2003 | Shi et al. | 165/133 |

FOREIGN PATENT DOCUMENTS

| | | |
|---|---|---|
| DE | 33 16 693 C2 | 11/1984 |
| DE | 34 37 898 A1 | 5/1985 |
| DE | 195 02 568 C1 | 7/1996 |
| DE | 195 23 208 A1 | 1/1997 |
| DE | 196 25 329 A1 | 1/1998 |
| DE | 196 44 692 A1 | 4/1998 |
| DE | 199 55 971 A1 | 1/2001 |
| DE | 100 26 477 A1 | 11/2001 |
| EP | 0 279 898 A1 | 8/1988 |
| EP | 0 596 619 A1 | 5/1994 |
| EP | 0 625 588 A1 | 11/1994 |
| EP | 0 718 418 A1 | 6/1996 |
| EP | 0 752 293 A2 | 1/1997 |
| EP | 0 470 644 B1 | 3/1999 |
| EP | 0 909 835 A1 | 4/1999 |
| EP | 0 835 332 B1 | 5/2000 |
| EP | 1 186 749 A1 | 3/2002 |
| JP | 63307196 | 12/1988 |
| JP | 02154993 | 6/1990 |
| JP | 03044485 | 2/1991 |
| JP | 03053070 | 3/1991 |
| WO | WO 96/41901 | 12/1996 |
| WO | WO 99/43865 | 9/1999 |
| WO | WO 00/75394 | 12/2000 |

OTHER PUBLICATIONS

Search Report in PCT/IB01/02079 (Jan. 29, 2002).
Search Report in DE 100 56 242.6 (Sep. 11, 2001).

* cited by examiner

*Primary Examiner*—Teresa J. Walberg
(74) *Attorney, Agent, or Firm*—Cermak & Kenealy, LLP; Adam J. Cermak

(57) ABSTRACT

The heat transfer surfaces of a condensation heat exchanger are provided with a coating according to the invention which comprises a sequence of layers which includes at least one hard layer which comprises amorphous carbon or a plasma polymer and at least one soft layer which comprises amorphous carbon or a plasma polymer. The hard and soft layers are applied alternately, the first layer on the heat transfer surface being a hard layer and the last layer of the coating being a soft layer. The last, soft layer is distinguished in particular by hydrophobic properties. The layer sequence ensures condensation of drops and, at the same time, protects against drop impingement erosion.

8 Claims, No Drawings

CONDENSATION HEAT-TRANSFER DEVICE

BACKGROUND OF THE INVENTION

1. Field of the Invention

The invention relates to a condensation heat exchanger for condensation of nonmetallic vapors, and in particular to a coating of the heat transfer surfaces of the condensation heat exchanger. The coating is used to extend the service life of the cooling tubes and to improve the heat transfer at the heat transfer surfaces.

2. Discussion of Background

In condensation heat exchangers, the lifespan of the heat transfer surfaces plays an important role, since damage to the heat transfer surfaces causes the entire installation in which the condensation heat exchanger is installed to fail. The state of the heat transfer surfaces of condensation heat exchangers is adversely affected, inter alia, by drop impingement erosion and corrosion. Damage caused by drop impingement erosion occurs in particular at those heat transfer surfaces which are exposed to a high-speed flow of steam. There, drops which are present in the steam which is to be condensed impinge on the heat transfer surfaces, energy being transferred to the surface by the impact or by shear forces. Erosion occurs if, in the event of very frequent drop impingement, the energy transferred is sufficient to plastically deform the surface material, leads to creep in the case of ductile materials or leads to intercrystalline fatigue failure in the case of hard materials.

With steam condensers in steam power plants, it has been observed that relatively large drops with diameters in the region of 100 $\mu$m and velocities of 250 m/s cause drop impingement erosion. In particular the cooling tubes at the periphery of a tube bundle are effected, while the tubes in the interior of a tube bundle remain protected from direct drop impingement erosion.

The occurrence of drop impingement erosion is highly dependent on the materials properties, such as hardness, ductility, elasticity, microstructure and roughness, materials made from titanium and titanium alloys being distinguished by a certain resistance to erosion, although this resistance is insufficient and predominantly due to their high hardness. In the case of steam condensers used in steam power plants, drop impingement erosion of this type is inhibited by a suitable selection of material for the cooling tubes, such as for example for stainless steel, titanium or chromium.

Furthermore, drop impingement erosion presents a problem in particular at low condenser pressures and therefore relatively high vapor velocities, as for example in steam condenses in steam power plants which are operating at part loads. When steam condenses on heat transfer surfaces, according to the prior art a film of condensate which spreads over the entire surface is formed. This film of condensate increases the overall thermal resistance between steam and cooling liquid flowing in the tubes, with the result that the heat transfer capacity is reduced. For this reason, there have long been efforts made to provide heat transfer surfaces with a coating which, by dint of hydrophobic properties, prevent the formation of a film of condensate, so that drop condensation occurs at the surface. The formation of drops allows the condensate to run off more quickly than if a film is formed. As a result, the surface of the heat exchanger is cleared, so that vapor can condense again at the surface without being impeded by a film of condensate. The overall heat resistance therefore remains relatively low. By way of example, layers of Teflon or enamel have been tried for this purpose, but without great success, since these layers had little resistance to erosion and corrosion.

In terms of the coating, it is important to solve the problem of the resistance to erosion and corrosion and also that of the bonding of the coating to the heat transfer surfaces. These problems need to be solved in particular in view of the desired long operating time of the condensation heat exchanger, such as for example in the cooling tubes of a steam condenser, which have to be able to operate for a period of several years.

An example of a coating is disclosed by WO 96/41901 and EP 0 625 588. These documents describe a metallic heat transfer surface with what is described as a hard-material layer comprising plasma-modified amorphous hydrocarbon layers, also known as diamond-like carbon. Amorphous carbon is known for its elastic, extremely hard and chemically stable properties. The wetting properties of the hard-material layer of amorphous carbon are altered by the incorporation of elements such as fluorine and silicon, in such a manner that the layer acquires hydrophobic properties. For bonding to the substrate, an interlayer is applied between the substrate and the hard-material layer, the transition from the interlayer to the hard-material layer being produced by means of a gradient layer. However, the hard-material layer is ultimately only resistant to erosion on account of its inherent hardness.

DE 34 37 898 has described a coating for the surfaces of a heat exchanger, in particular for the surfaces of condenser cooling tubes, comprising a triazine-dithiol derivative. This layer material effects drop condensation and therefore improves the heat transfer. Furthermore, the coating is distinguished by good bonding to the cooling tubes.

DE 196 44 692 describes a coating comprising amorphous carbon which brings about drop condensation on the cooling tubes of steam condensers. The surface of a cooling tube is roughened prior to the application of the amorphous carbon, with the result that the effective interface between the cooling tubes surface and the coating is increased. As a result, the heat resistance between coating and base material is reduced. After the coating, the surface is smoothed, so that coated and uncoated regions are formed next to one another.

SUMMARY OF THE INVENTION

Accordingly, one object of the invention is to provide a novel coating for the heat transfer surfaces of a condensation heat exchanger for the condensation of nonmetallic vapors, the resistance of which with respect to drop impingement erosion and corrosion is increased compared to the prior art and at which, at the same time, improved heat transfer is effected as a result of drop condensation being brought about.

This object is achieved by a condensation heat exchanger in accordance with claim 1. The heat transfer surfaces of a condensation heat exchanger have a coating which contains amorphous carbon, also known as diamond-like carbons. According to the invention, the coating comprises a layer sequence including at least one hard layer made from amorphous carbon and at least one soft layer made from amorphous carbon, the hard and soft layers being applied alternately and the bottom or first layer on the heat transfer surface being a hard layer and the top or last layer of the layer sequence being a soft layer. The last, soft layer of the layer sequence in particular has hydrophobic or water-repellent properties.

The coating according to the invention therefore, on account of its last or outermost layer, makes the entire layer system hydrophobic. This property is based on the low surface energy of amorphous carbon when it is relatively soft.

In the text which follows, the term amorphous carbon is to be understood as meaning hydrogen-containing carbon layers with a hydrogen content of 10 to 50 atomic % and with a ratio of $sp^3$ to $sp^2$ bonds of between 0.1 and 0.9. In general, it is possible to use all amorphous or dense carbon layers produced by means of carbon or hydrocarbon precursors as well as plasma polymer layers, polymer-like or dense carbon and hydrocarbon layers, provided that they have the hydrophobic properties and also the mechanical or chemical properties of amorphous carbon mentioned below for the production of layer sequences.

The wettability of the surface made from amorphous carbon can be altered by varying its hardness. The higher the hardness, the lower the wettability becomes. A very hard layer with a hardness of, for example, more than 3000 Vickers would be less suitable as an outermost, hydrophobic layer than a layer of lower hardness.

The formation of extended films of condensate on the soft, hydrophobic surface is prevented since the condensate instead forms drops which, once they have reached a certain size, run off the surface of the tube. In this case, on the one hand a larger part of the area of the heat transfer surface remains free of condensate, and on the other hand the residence time of the condensate on a given heat transfer surface is also greatly reduced. This increases the heat transfer at the surfaces and ultimately improves the performance of the condensation heat exchanger.

The layer sequence according to the invention, comprising in each case a hard layer followed by a soft layer, in particular effects an increased resistance to drop impingement erosion. The impulse of impinging drops is absorbed by the soft and hard layers by the compression waves which originate in the surface material from the impingement of the drops being attenuated by interference by the pairs of hard and soft layers. This attenuation of compression waves is similar to the attenuation of optical waves brought about by layer pairs of thin layers with a high and low refractive index, respectively.

The attenuation of compression waves is increased by a layer sequence comprising a plurality of layer pairs of hard and soft layers. An optimum number of layers is dependent on the angle of inclination of the direction of impingement of the drops on the surface. If they impinge obliquely, a smaller number of layers is required to attenuate the compression waves.

The overall heat resistance of the coated heat transfer surface increases as the number of layers and the layer thickness rise. Therefore, the number of layers is to be optimized on the basis of the absorption of the compression waves which originate from the impingement of drops and also on the basis of the total heat resistance of the heat transfer surfaces.

The combination of one or more layer pairs of hard and soft layers produces a greatly improved resistance to erosion compared to coatings comprising amorphous carbon with only one layer of relatively high hardness. At the same time, on account of its outermost, soft layer, the coating according to the invention has the ability to form drop condensation. As a result, increased resistance to drop impact erosion and, at the same time, a high heat transfer on account of the increased proportion of the area of the heat transfer surface which is free of condensate are ensured, so that both a lengthened service life of the heat transfer surfaces and an increased capacity on the part of the condensation heat exchanger are achieved.

The coating according to the invention is eminently suitable for the cooling tubes of condensation heat exchangers. The cooling tubes at which vapor of any described material is precipitated are arranged vertically or horizontally in tube bundles. In the case of a steam condenser, such as for example in a steam power plant, in particular the cooling tubes at the periphery of a tube bundle are more exposed to the drops which flow in at a high velocity than cooling tubes in the interior of a bundle. The two-layer or multi-layer coating is therefore particularly suitable for those cooling tubes which lie at the periphery. The cooling tubes in the interior of the bundle can be provided with the same coating or merely with a single, soft hydrophobic layer of amorphous carbon. This effects drop condensation with the associated increase in heat transfer. There is less need to protect against drop impingement erosion there.

As has been mentioned, the drop condensation reduces the residence time of the condensate on the cooling tubes of the steam condenser. This results in a reduction in the vapor-side pressure drop, the pressure drop being dependent on the size of the tube bundle and the volume of the condensate and on the plate width. The reduction in the vapor-side pressure drop produces an improvement in the overall heat transfer coefficient. Compared to condensers with uncoated cooling tubes, it is possible to increase the heat transfer coefficient by at least 25%, with the condensation heat exchanger being able to condense up to 20% more steam.

Furthermore, the coating is suitable for protecting against erosion and corrosion in heat exchangers, such as for example against ammonia erosion in steam condensers with heat transfer surfaces made in copper alloys. A further application is to protect against $SO_3$ or $NO_2$ corrosion in condensers used in apparatus for recuperation of heat from stack off-gases. In this application, the interfacial energy must be very low compared to the surface tension of the condensate. Since the surface tension of sulphuric acid is lower than that of water, therefore, the interfacial energy of the outermost layer generally has to be lower than in steam condensers. In this case, the hardness of the outermost layer should be between 600 and 1500 Vickers.

Furthermore, the coating according to the invention can be used in further condensation heat exchangers, such as for example in refrigeration machines and indeed any heat exchangers in which condensation takes place and drop impingement erosion has to be prevented.

The coating according to the invention can be produced using various, generally known production processes, such as for example deposition by means of glow discharge in a plasma comprising hydrocarbon-containing precursors, ion beam coating and sputtering of carbon in hydrogen-containing working gas. In these processes, the substrate is exposed to a current of ions of several 100 eV. During the glow discharge, the substrate is arranged in a reactor chamber in contact with a cathode which is capacitively connected to a 13.56 MHz RF generator. The grounded walls of the plasma chamber form a larger counter electrode. In this arrangement, it is possible to use any hydrocarbon vapor or an hydrocarbon gas as first working gas for the coating. To achieve particular layer properties, for example different surface energies, hardnesses, optical properties, etc., various gases are added to the first working gas. By way of example, high or low surface energies are achieved by adding nitrogen, fluorine- or silicon-containing gases. The addition of nitrogen additionally leads to an increase in the hardness of the layer which results. Furthermore, changing the bias voltage across the electrodes between 100 and 1000 V makes it possible to control the resulting hardness of the layer, a high bias voltage leading to a hard, amorphous carbon layer and a low voltage leading to a soft, amorphous carbon layer.

In an exemplary embodiment, the hardness of a hard layer of a layer pair is between 1500 and 3000 Vickers, while the hardness of a soft layer of a layer pair is between 800 and 1500 Vickers. The thicknesses of the individual layers are between 0.1 and 2 $\mu$m, preferably between 0.2 and 0.8 $\mu$m, if a plurality of layers are applied in succession in the layer sequence. The total layer thickness is in this case in the range from 2 to 10 $\mu$m, preferably between 2 and 6 $\mu$m. The thicknesses of the harder and softer layers are preferably inversely proportional to their hardnesses.

The coating according to the invention includes at least one layer pair comprising a hard layer and a soft layer. In this case, a larger number of layer pairs can be achieved, such as for example two layer pairs in each case comprising one hard layer and one soft layer, provided that the layer sequence begins with a hard layer and ends with a soft layer with hydrophobic properties. The greater the number of layers, the better the attenuation of the impingement energy works, but also the higher the heat resistance becomes, since the hard and soft layers have different thermal conductivities.

The coating according to the invention bonds well to most types of substrates, in particular with materials which form carbides, such as for example titanium, iron and silicon as well as aluminum, but not to precious metals, copper or copper-nickel alloys. In this case, it is not necessary to roughen the substrate surface to improve the bonding. If the coating is applied to a smooth substrate surface, the result is a layer assembly which is even more resistant to drop impingement erosion, since this reduces the absorption of the impact energy by the base material. Therefore, the coating according to the invention can be applied to various substrate materials which are used for the heat transfer surfaces, such as for example titanium, stainless steel, chromium steels, aluminium and all carbide-forming elements.

What is claimed is:

1. A condensation heat exchanger comprising:

heat transfer surfaces for condensation of nonmetallic vapors, the heat transfer surfaces having a coating which contains amorphous carbon, and the surface of the coating having hydrophobic properties;

wherein the coating, in order to attenuate compression waves which originate from the surface of the coating as a result of the impingement of drops, comprises two or more layer pairs, each layer pair including a hard layer comprising amorphous carbon or a plasma polymer and a soft layer comprising amorphous carbon or a plasma polymer, and the hard and soft layers being applied alternately and the last layer being a soft layer.

2. The condensation heat exchanger as claimed in claim 1, wherein the thickness of each of the hard and soft layers is inversely proportional to their hardness.

3. The condensation heat exchanger as claimed in claim 1, wherein the hard layers each have a hardness in the range from 1500 to 3500 Vickers and the soft layers have a hardness in the range from 600 to 1500 Vickers.

4. The condensation heat exchanger as claimed in claim 1, wherein the thickness of each of the hard and soft layers of the coating is between 0.1 and 2 micrometers.

5. The condensation heat exchanger as claimed in claim 1, wherein the coating includes a plurality of layer pairs in each case comprising a hard layer and a soft layer, and the total thickness of the coating is between 2 and 10 micrometers.

6. The condensation heat exchanger as claimed in claim 1, wherein the heat transfer surfaces comprise titanium, stainless steel, chromium steel, aluminum, copper alloys or carbide-forming elements.

7. The condensation heat exchanger as claimed in claim 1, wherein the coating inhibits ammonia erosion or corrosion.

8. The condensation heat exchanger as claimed in claim 1, further comprising:

tube bundles comprising a plurality of cooling tubes which are arranged vertically or horizontally and on which vapor of any desired substance can precipitate;

outer cooling tubes at the periphery of the tube bundles having the coating comprising at least one hard layer and at least one soft layer; and inner cooling tubes of the bundles having the same coating or a coating comprising only a soft, hydrophobic layer comprising amorphous carbon.

* * * * *